United States Patent [19]

Berryman et al.

[11] Patent Number: 4,701,095

[45] Date of Patent: Oct. 20, 1987

[54] TRANSPORTABLE MATERIAL CONVEYING APPARATUS

[75] Inventors: Leslie N. Berryman; Gail F. Davis; Herbert J. Horinek, all of Duncan, Okla.

[73] Assignee: Halliburton Company, Duncan, Okla.

[21] Appl. No.: 894,440

[22] Filed: Jul. 31, 1986

Related U.S. Application Data

[63] Continuation of Ser. No. 687,094, Dec. 28, 1984, abandoned.

[51] Int. Cl.[4] ..... B65G 67/02

[52] U.S. Cl. ..... 414/332; 198/311; 198/314; 222/564; 414/289; 414/505; 414/523

[58] Field of Search ..... 414/267-269, 414/289, 332, 919, 523, 501-505; 366/181, 336, 337; 222/547, 564; 198/311, 575, 577, 579, 588, 314, 861.6, 317

[56] References Cited

U.S. PATENT DOCUMENTS

| | | | |
|---|---|---|---|
| 710,611 | 10/1902 | Ray | 414/523 X |
| 1,731,675 | 10/1929 | McCoy | 222/564 X |
| 2,475,590 | 7/1949 | Carbert | 414/519 |
| 2,552,569 | 5/1951 | McNamara | 414/289 X |
| 2,555,914 | 6/1951 | Beech | 198/588 |
| 2,564,020 | 8/1951 | Mengel | 414/523 |
| 2,915,205 | 12/1959 | Strader | 414/289 |
| 3,159,288 | 12/1964 | Heise | 414/332 |
| 3,706,370 | 12/1972 | Bonafino et al. | 198/575 |
| 3,863,783 | 2/1975 | Spellman, Jr. | 198/588 X |
| 3,917,084 | 11/1975 | Swisher, Jr. et al. | 414/523 |
| 4,030,633 | 6/1977 | Fisher | 222/564 X |
| 4,265,266 | 5/1981 | Kierbow et al. | 137/101.19 |
| 4,304,493 | 12/1981 | Frankie | 366/181 X |
| 4,353,482 | 10/1982 | Tomlinson et al. | 222/1 |
| 4,410,106 | 10/1983 | Kierbow et al. | 222/135 |
| 4,427,133 | 1/1984 | Kierbow et al. | 222/77 |
| 4,538,221 | 8/1985 | Crain et al. | 364/172 |
| 4,538,222 | 8/1985 | Crain et al. | 364/172 |

OTHER PUBLICATIONS

Exhibit A-Attached Photograph.
Exhibit B-Attached Photograph.
Exhibit C-Attached Photograph.
Exhibit D-Attached Photograph.
Exhibit E-Attached Photograph.
Exhibit F-Attached Photograph.
Exhibit G-Attached Photograph.
Exhibit H-Attached Photograph.
Exhibit I-Attached Photograph.
Exhibit J-Attached Photograph.
Exhibit K-Attached Photograph.
Exhibit L-Attached Photograph.
Exhibit M-Attached Photograph.
Exhibit N-Attached Photograph.
Exhibit O-Attached Photograph.
Exhibit P-Attached Photograph.

*Primary Examiner*—Joseph E. Valenza
*Assistant Examiner*—David A. Bucci
*Attorney, Agent, or Firm*—James R. Duzan

[57] ABSTRACT

A transportable material conveying apparatus includes a frame having a surge bin mounted on the frame for receiving, holding and discharging particulate material. A gathering conveyor is mounted on the frame for gathering the particulate material and delivering the particulate material into the surge bin. A discharge conveyor is mounted on the frame below an outlet of the surge bin for receiving the particulate material from the outlet and for conveying the particulate material to a discharge point.

18 Claims, 12 Drawing Figures

TRANSPORTABLE MATERIAL CONVEYING APPARATUS

This application is a continuation of application Ser. No. 687,094, filed Dec. 28, 1984, now abandoned.

BACKGROUND OF THE INVENTION

1. Field of the Invention

The present invention relates generally to transportable apparatus for conveying particulate materials, and particularly to a transportable conveyor system for handling great volumes of sand or other proppant material and discharging the same at uniform rates to blender apparatus which blend the proppant with various liquids so that the same may be pumped down into an oil or gas well as part of a formation fracturing operation.

2. Description of the Prior Art

Increasing technology and improved techniques have resulted through the years in the use of greater volumes and higher concentrations of proppant in hydraulic fracturing operations in the oil field. This increased use of proppant has created the demand for more dependable proppant handling equipment capable of moving large amounts of proppant from on-location storage to the blending apparatus with little or no spillage. The system must also provide a steady, even flow of proppant to the blender to prevent fluctuations, in concentration rates being pumped down into the well.

For many years, the prior art has included the use of belt conveyors for gathering proppant material from a plurality of sources such as fixed bins or transportable storage bins, and for delivering the proppant to a blending apparatus.

Additionally, separate transfer conveyors capable of being swiveled about a vertical axis have been utilized at the end of the primary conveyor in order to permit the flow from the primary conveyor to be transferred to a plurality of blending apparatus.

With the prior art apparatus, and with the apparatus of the present invention, the primary purpose of the proppant conveying system is to maintain a steady and sufficient flow of proppant to the blending apparatus.

It is in the blending apparatus where the correct proportions of proppant to liquid are determined, and this can only be done by maintaining a steady supply of proppant to the blending apparatus.

The particular blending apparatus utilized by the assignee of the present invention includes a feeding machine consisting of a plurality of screw conveyors. Thus, the job of the proppant conveying system is to keep the intake portion of the screw conveyors full so that the screw conveyors will always convey a full load of proppant. This is necessary because the blending apparatus calculates the volume of proppant based upon the speed of the screw conveyors and the assumption that the conveyors are fully loaded.

The intake portion of the screw conveyors itself may be thought of as consisting of a relatively small hopper.

The problem encountered in the prior art, and to which the present invention is particularly directed, is that the volume of this small intake hopper on the blending apparatus is very much less than the volume of material which at any one time is being carried by the sand conveying apparatus.

Also, the lag time between the placement of proppant material on the conveyor and the delivery of that material to the blender apparatus is significant, on the order of as much as twenty seconds, and the amount of material which the conveyor system transports during that lag time very much exceeds the volume of the small intake hopper on the blender apparatus.

To appreciate the problem encountered by the operator of the conveyor system, it must be appreciated that the conveyor system operator does not generally control the requirements of the blender apparatus, but instead must respond to the needs of the blender apparatus. His job basically is to observe the intake hopper of the blender apparatus and make certain it is always substantially full of proppant material, but also he of course does not want to overfill the intake hopper of the blender apparatus since that would result in a waste of proppant material.

The job of the conveyor operator through the years has become increasingly more difficult as the size of hydraulic fracturing operations has increased so that the rates at which proppant must be supplied to the blenders has accordingly increased.

The situation has reached the point where with prior art apparatus, it is very difficult for a human operator to repsond quickly enough to the situation he observes at the intake of the blender apparatus. When the demand for proppant at the blender decreases, it is difficult, if not impossible, for the human operator to stop the supply of proppant to the blender before overflowing the blender intake hopper. Similarly, the blender can quickly exhaust the small supply of proppant which it holds in its intake hopper before the human operator of the conveyor system can deposit proppant material on the conveyor and transport it by means of a conveyor to the blender apparatus.

Thus, the need has developed for a system which can smooth out or reduce fluctuations in the flow of proppant material to the blender apparatus, at relatively high flow rates of proppant material.

The prior art includes devices which have attempted to do this through the use of a surge bin located immediately adjacent the blender apparatus. In some instances, these surge bins have actually been comprised of an extension to the intake hopper of the blender apparatus.

Another prior art device has provided such a surge bin on the rear end of a transportable conveyor system, wherein the surge bin was designed to be located immediately above the intake hopper of a blender apparatus so that the contents of the surge bin were dumped directly into the blender apparatus.

Thus, although the prior art has contemplated the general problem addressed by the present invention, namely the provision of a proppant transport system which can handle relatively large volumes of material and which provides some means within the system for temporary storage of material being conveyed, there still has not prior to the present invention been provided a completely integrated transportable system which is capable of receiving proppant material from a plurality of sources, temporarily holding that material in a surge bin contained within the transportable system, and then discharging the proppant material from the surge bin and conveying the material to a variable discharge point relative to the surge bin.

SUMMARY OF THE INVENTION

The present invention provides a completely integrated transportable proppant conveying system which solves many of the problems encountered by the prior art apparatus mentioned above.

The transportable material conveying apparatus of the present invention includes a transportable frame having a surge bin mounted on the frame for receiving, holding and discharging particulate material.

A gathering conveyor is mounted on the frame for gathering the particulate material and delivering the particulate material into the surge bin.

A discharge conveyor is also mounted on the frame below an outlet of the surge bin for receiving the particulate material from the outlet and for conveying the particulate material to a discharge point.

The surge bin has a holding capacity greater than a volume of particulate material which can be carried at one time by the gathering conveyor.

The surge bin has internal level sensors associated with external level indicators, so that a human operator of the gathering conveyor system and of the systems which are placing proppant material on the gathering conveyor can at all times monitor the level of material in the surge bin and accordingly vary the input of material to the surge bin. Thus, this first human operator can concentrate solely on the job of keeping the level of proppant material in the surge bin at an acceptable level.

The discharge conveyor is mounted upon the frame in a very flexible manner so that it can both be pivoted relative to the frame about a vertical axis, and extended horizontally relative to the frame. This allows the discharge point of the discharge conveyor to be varied within a relatively wide area extending both horizontally from the frame and through an arc relative to the frame. This allows the discharge point to be located over any one of a plurality of blender intakes, so that the discharge of proppant material can be substantially immediately switched from one blender intake to another blender intake.

Numerous objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1:
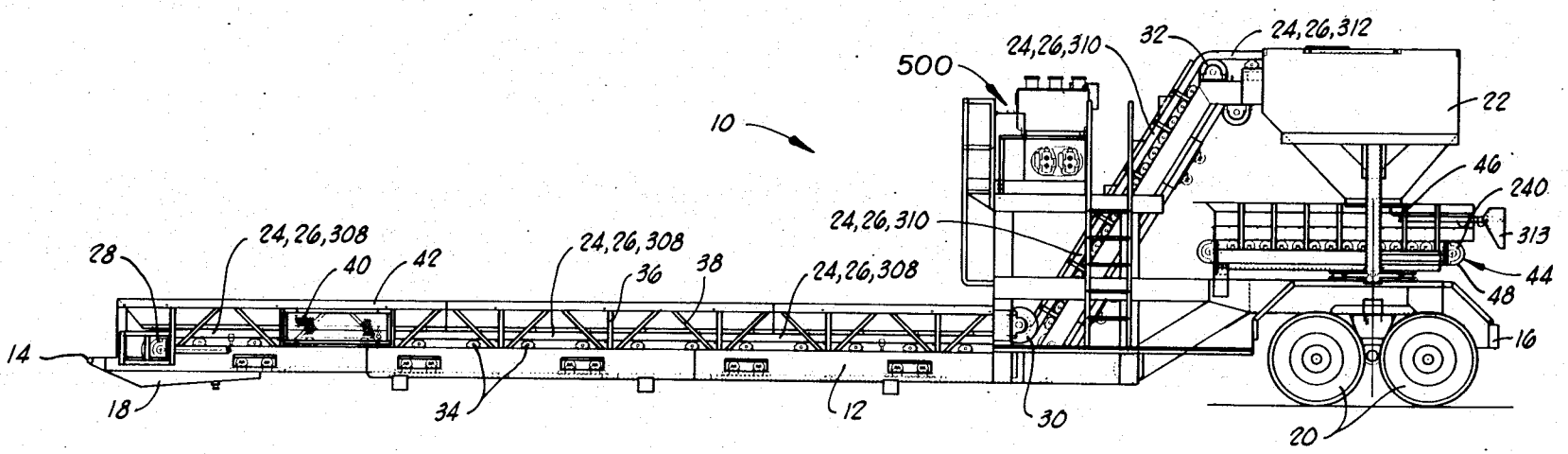
FIG. 1 is a side elevation view of the transportable material conveying apparatus of the present invention, with the forward end of the apparatus being located to the left and the rearward end of the apparatus being located to the right in FIG. 1.

Referring now to the drawings, and particularly to FIG. 1, the transportable material conveying apparatus of the present invention is shown and generally designated by the numeral 10.

The apparatus 10 includes a transportable frame 12 having a forward end 14 and a rearward end 16.

A conventional "fifth wheel" device 18 is attached to the frame 12 near its forward end 14 for connection of the frame 12 to a semi-trailer/tractor for transporting the apparatus 10.

A plurality of wheels 20 support the rear end 16 of the frame 12 from the ground.

A surge bin means 22 is mounted on the frame 12 for receiving, holding and discharging particulate material. The particulate material generally involved is sand which is utilized as a proppant in hydraulic well fracturing operations.

An elongated gathering conveyor means 24 is mounted on the frame 12 for gathering the particulate material and delivering the material into the surge bin means 22. The gathering conveyor means 24 includes an endless conveyor belt 26 which is continuously moved about a plurality of pulleys such as pulleys 28, 30 and 32, among others which are not seen in FIG. 1, and which is supported by a plurality of rollers such as those designated by the numeral 34.

The gathering conveyor belt 26 is itself of basically conventional design, and is located within a framework consisting of side walls defined by vertical structural members such as 36 and 38, covered by a screen or grating type material such as 40. Similarly, the top of the enclosure is defined by horizontal rails such as 42 on either side of the conveyor 24 and is covered by a grating through which the particulate material can pass. Also, the top grating functions to direct the particulate material downwardly onto the gathering conveyor 24.

The transportable material conveying apparatus 10 further includes a discharge conveyor means generally designated by the number 44.

The discharge conveyor means 44 is mounted on the frame 12 below an outlet 46 of surge bin means 22 for receiving the particulate material from the outlet 46 and for conveying the particulate material to a discharge point defined by the location of the rear end 48 of the discharge conveyor 44.

The surge bin means 22 has a holding capacity which is greater than a volume of particulate material which can be gathered at one time by the gathering conveyor means 24, and in a preferred embodiment of the present invention, the surge bin means 22 has an effective holding capacity of approximately 100 cubic feet. This capacity provides sufficient material for approximately twenty seconds running time of the blender with which the apparatus 10 is designed to be utilized.

Figure 4:
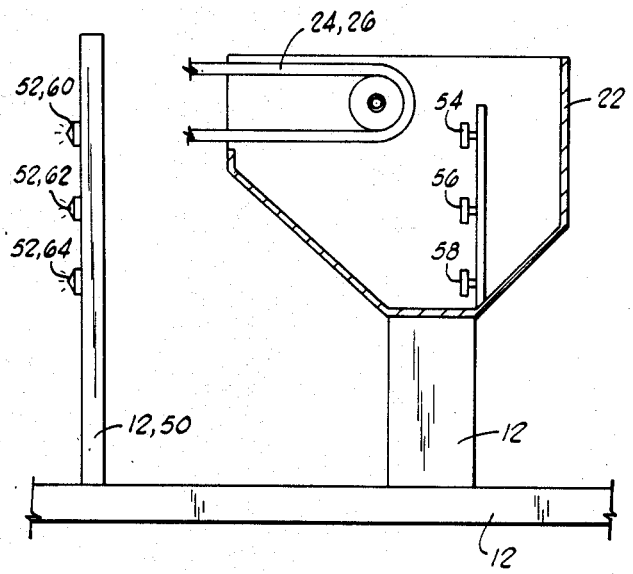
FIG. 4 is a schematic section elevation view of the surge bin illustrating the level sensors and external level indicators.

FIG. 4 schematically illustrates the surge bin means 22 as mounted on the frame 12, and shows the surge bin means 22 in cross section, with the rearward portion of the gathering conveyor means 24 located at an upper end of the surge bin means 22.

On a portion 50 of frame 12 is located an external level indicator means 52 operably associated with the surge bin means 22 for providing a visually observable indication of a level of particulate material within the surge bin means 22.

The portion 50 of frame 12 is shown very schematically in FIG. 4, and can be located at any place upon the frame 12 which can readily be observed by a human operator who is in a position to control the input of particulate material onto the gathering conveyor 24.

The external level indicator means 52 preferably includes a plurality of discrete level sensors 54, 56, and 58 located within the surge bin 22, and a plurality of external indicator lights 60, 62 and 64. Each one of the indicator lights 60, 62, 64 is associated with one of the level sensors 54, 56, 58, and the sensors and indicator lights are interconnected so that each of the lights is on when the level of particulate material is at or above its associated sensor, and each of the lights is off when the level of particulate material is below its associated sensor.

In the embodiment schematically illustrated in FIG. 4, sensors 54, 56 and 58 may be referred to as upper, intermediate and lower level sensors, respectively. Also, the lights 60, 62 and 64 may be referred to as upper, intermediate and lower indicator lights. The upper indicator light 60 is associated with upper sensor 54; the intermediate indicator light 62 is associated with intermediate sensor 56; and the lower indicator light 64 is associated with lower sensor 58.

It has been determined that a preferred manner of operation of the apparatus 10 with regard to the supply of particulate material from the gathering conveyor to the surge bin 22 is accomplished in the following manner.

First, the conveying speed of the gathering conveyor means 24 is set at a fixed predetermined rate. The human operator controlling placement of particulate material onto the gathering conveyor 24 then controls the level of particulate material within the surge bin means 22 by controlling the amount of material placed upon the gathering conveyor 24.

It has been found that the apparatus 10 operates in a very satisfactory manner when the human operator controlling the level within the surge bin means 22 attempts to keep the lower and intermediate indicator lights 64 and 62 on and the upper indicator light 60 off.

Alternatively, instead of having a plurality of discrete level sensors and a plurality of discrete external level indicators, the level indicator 52 can be constructed to provide a continuous monitoring of material level throughout the height of the surge bin 22.

Figure 3:
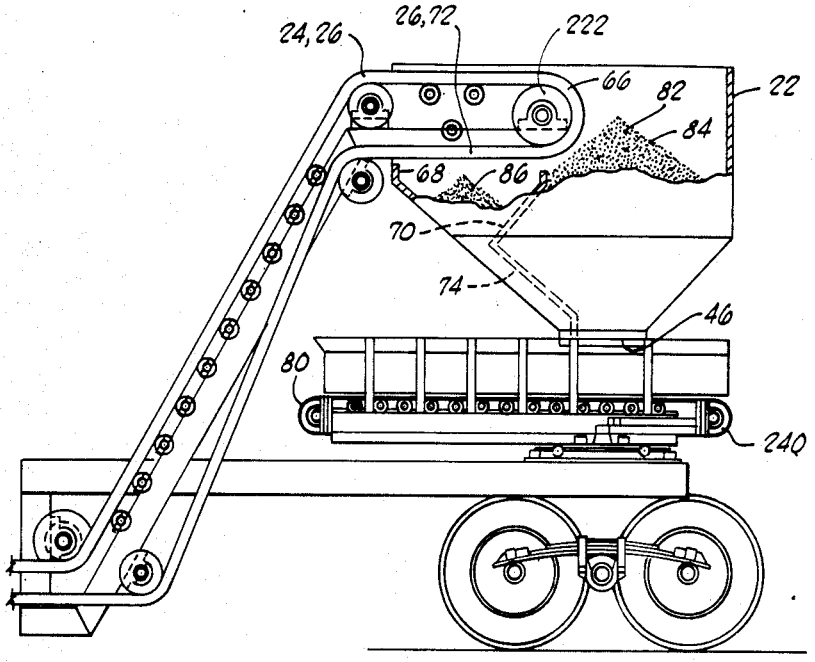
FIG. 3 is a somewhat schematic side elevation, partly sectioned view of the rear portion of the apparatus of FIG. 1 particularly illustrating the association of the surge bin with the rear portion of the gathering conveyor and with the discharge conveyor.

Referring now to FIGS. 1 and 3, it is seen that the gathering conveyor means 24 extends over a front wall 68 of surge bin 22, and has a discharge end 66 thereof located above the surge bin means 22 for discharging particulate material from the endless belt 26 into an upper end of the surge bin means 22.

The surge bin means 22 includes a carryover hopper means 70 located directly below a return portion 72 of endless belt 26 between the wall 68 of the surge bin means 22 and the discharge end 66 of the gathering conveyor means 24, for receiving particulate material carried past the discharge end 66 of the gathering conveyor means 24 by the return portion of the endless belt 26.

Figure 5:
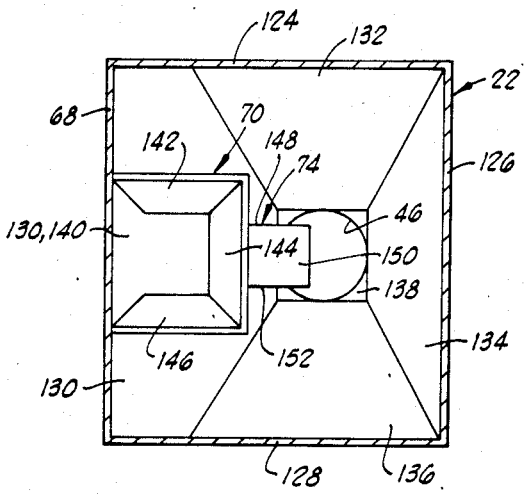
FIG. 5 is a plan section view of the surge bin.
Figure 6:
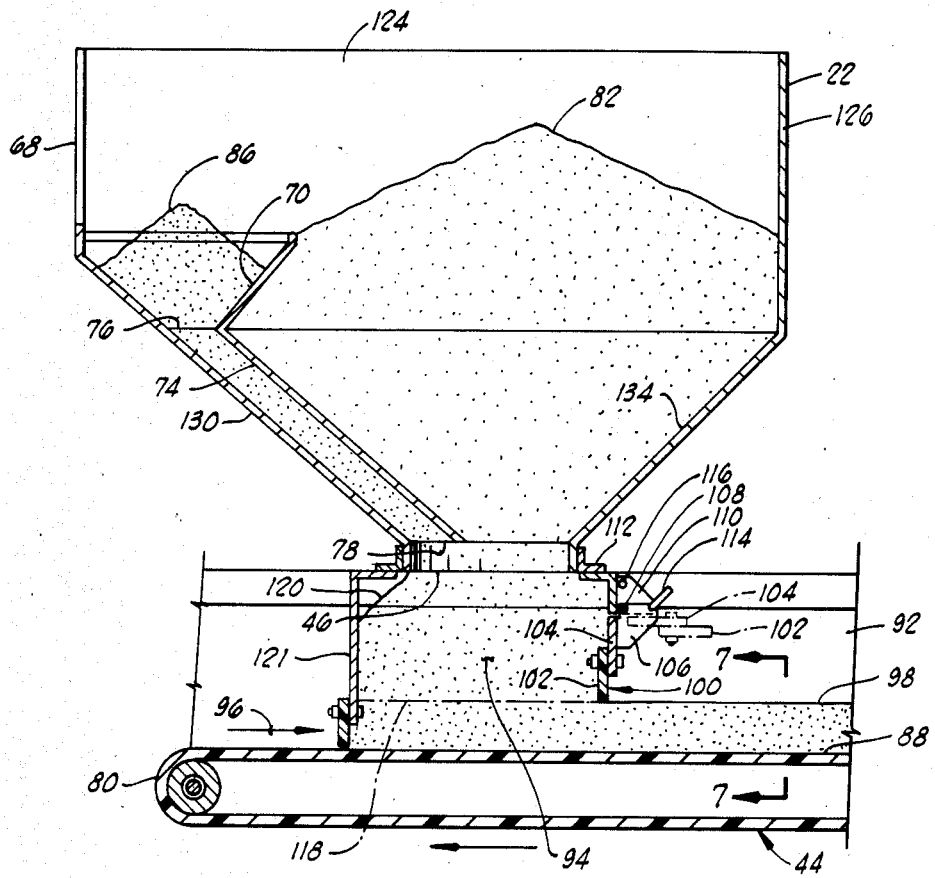
FIG. 6 is an elevation section view of the surge bin which illustrates the construction of the carryover hopper, and somewhat schematically illustrates the manner of association of the surge bin with the discharge conveyor and with a screed means which controls the level of material on the discharge conveyor.

The carryover hopper means 70 is perhaps best illustrated in FIGS. 5 and 6.

A carryover discharge chute 74 has its upper end 76 communicated with the lower end of carryover hopper 70, and has its lower end 78 communicated with a portion of the outlet 46 of surge bin means 22 nearest an upstream end 80 of discharge conveyor means 44, so that particulate material is prevented from piling up within the surge bin means 22 below the return portion 72 of the endless belt 26 of the gathering conveyor means 24.

Figure 7:
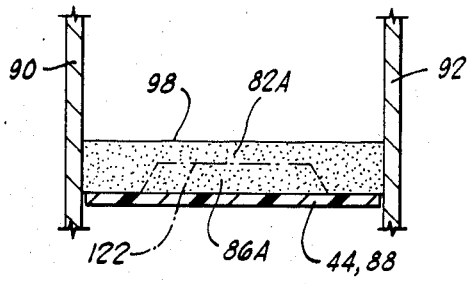
FIG. 7 is an elevation section view taken along line 7—7 of FIG. 6.

The manner of operation of the surge bin means 22, and of the carryover hopper 70 and carryover discharge chute 74 thereof, in association with the discharge conveyor means 44 can best be appreciated by viewing FIGS. 3, 6 and 7.

First, it is noted that the surge bin means 22 is so constructed that all of the particulate material contained in the surge bin means 22 can be discharged through the single outlet 46 to thereby prevent the formation of dead spaces within the surge bin means 22 where substantial volumes of particulate material might be trapped.

Certain of the prior art devices which have utilized surge bins on a transportable apparatus have constructed the surge bins in such a manner that the effective holding capacity of the surge bin was greatly reduced due to the fact that the entire volume of the surge bin could not be discharged from a single outlet.

Referring to FIG. 3, the particulate material leaving the discharge end 66 of gathering conveyor means 24 will, for the most part, form a first pile 82 of particulate material which will have sloped sides such as 84 determined by the angle of repose and other properties of the material.

One particular problem encountered with the use of a horizontally oriented endless conveyor belt such as the belt 26, and particularly when such a belt is moving at a relatively rapid speed, is that a relatively small but significant portion of the particulate material carried by the belt 26 will not be immediately ejected from the discharge end 66 onto the first pile 82, but rather a small portion of the material will be carried by the return portion 72 of the belt 26 and will tend to gather under the return portion 72. This can create significant problems, due to the friction between the return portion of the belt 72 and the material which may pile up under it.

With the particular design of the surge bin means 22 having the carryover hopper 70 located below the return portion 72 of conveyor belt 26, a smaller second pile 86 of particulate material is collected in the carryover hopper 70, and is comprised primarily of material which is "carried over" past the discharge point 66 by the return portion 72 of the conveyor belt 26.

The second pile 86 of particulate material located within the carryover hopper 70 is communicated by the carryover discharge chute 74 with the outlet 46 of surge bin means 22, and particularly with a portion of the outlet 46 closest to the upstream end 80 of the discharge conveyor 44.

There is superimposed in FIG. 6 over the structural representations of the surge bin means 22, an outline of the first pile 82 and the second pile 86 of particulate material, and it is seen that this particulate material discharges in a mass 94 of particulate material below the outlet 46 of surge bin means 22.

This material engages an upper portion 88 of an endless conveyor belt which forms a portion of the discharge conveyor means 44. Upper portion 88 of the discharge conveyor belt is shown running relative closely in place between two vertical metal side walls 90 and 92 which are also a part of the discharge conveyor means 44.

To appreciate the manner in which the carryover hopper 70 and carryover discharge chute 74 function, the mechanics of how the mass of particulate material 94 is engaged and carried away by the discharge conveyor means 44 must be understood.

As indicated by the arrow 96 adjacent upper portion 88 of the conveyor belt of discharge conveyor means 44 in FIG. 6, this upper portion 88 is moving from left to right in FIG. 6.

The upper level 98 of the particulate material which will actually be carried away by the belt 88 is determined by an adjustable screed means 100 which is associated with the discharge conveyor means 44 on a downstream side of the outlet 46 of surge bin means 22 for controlling a cross-sectional area of particulate material which can be carried on the conveyor belt 88 of discharge conveyor means 44.

The adjustable screed means 100 includes a flat rubber screed member 102 which is attached to a screed plate 104 which is itself attached to a bracket 106. The bracket 106 is pivotally connected at 108 to a bracket 110 which is attached to a support member 112 depending from the surge bin means 22.

The adjustable screed means 100 is shown in FIG. 6 as its lower position, and it is held in that position by a releasable pin 114 which fits through complimentary holes in the bracket members 106 and 110.

To increase the cross-sectional area which can be carried by the belt 88, the pin 114 is removed, and the support bracket 106 with its attached screed plate 104 and rubber screed 102 are rotated counterclockwise about the pivot 108 until the pin 114 is in registry with an upper pin hole 116 of bracket 110, in which position the screed plate 104 and rubber 102 are in an approximately horizontal position.

Alternatively, the adjustable screed means 100 can be constructed to provide an infinitely adjustable position of the rubber screed 102.

Returning to the explanation of the mechanics of how the mass of particulate material 94 is carried away by the discharge conveyor 88, it will be appreciated that as the belt 88 moves to the right carrying the material under the rubber screed 102, a shear line is generally formed within the particulate mass 94 at the location indicated by the phantom line 118.

Thus, material which does not fall to a point below the phantom shear line 118 will not be carried away by the belt 88.

The material actually carried by the belt 88 will be the material building up on the upstream side 120 of the particulate mass 94. An upstream barrier or rear screed 121 contains the particulate material on the conveyor belt 88.

By orienting the lower end 78 of carryover discharge chute 74 adjacent the upstream side of outlet 46 of surge bin means 22, the material gathering in the second pile 86, which is carried over by the return portion 72 of gathering conveyor belt 26 will be among this material which is first encountered by the belt 88 and which accordingly is the material actually carried away by the belt 88.

Thus, the material in the second pile 86 will be discharged from the surge bin 22 before the material in the first pile 82.

This prevents particulate material from building up under the return portion 72 of gathering conveyor belt 26 and prevents the associated problems previously mentioned.

Tests run by applicants have determined that the phenomena just explained with regard to the carryover hopper 70 and carryover discharge chute 74 does in fact occur. Tests have been run with a scale model of the surge bin means 22 in which the first pile 82 of particulate material has been of a first color and the second pile 86 of particulate material has been material of a second color.

The material discharged from such a system is very definitely segregated on the discharge belt such that it is separated by a phantom line such as line 122 in FIG. 7, with material from the first pile 82 being designated by the numeral 82A and located outside the phantom line 122, and with material from the second pile 86 being designated by the numeral 86A and being located inside the phantom line 122.

The details of construction of the surge bin means 22, the carryover hopper means 70 and the carryover discharge chute 74 are best seen with regard to FIGS. 5 and 6.

FIG. 5 is a plan section view taken above the upper extremity of the carryover hopper means 70, and it shows the forward vertical wall 68 of surge bin means 22 previously mentioned, along with other vertical walls 124, 126, and 128.

The four vertical walls 68, 124, 126 and 128 are associated with basically trapezoidal shaped sloped lower wall portions 130, 132, 134 and 136, respectively, all of which are joined together, and which at their lower ends are attached to a horizontal square plate 138 which has the round outlet 46 cut therein.

The carryover hopper 70 is partially defined by an intermediate portion 140 of tapered side wall 130 and is further defined by trapezoidal sheet metal portions 142, 144 and 146 which are joined together to define an inverted pyramid-shaped hopper 70.

The carryover discharge chute 74 is rectangular in cross section, with its forward side being defined by the sloped side 130 of surge bin means 22 and being further defined by three flat metal sections 148, 150 and 152.

Figure 9:
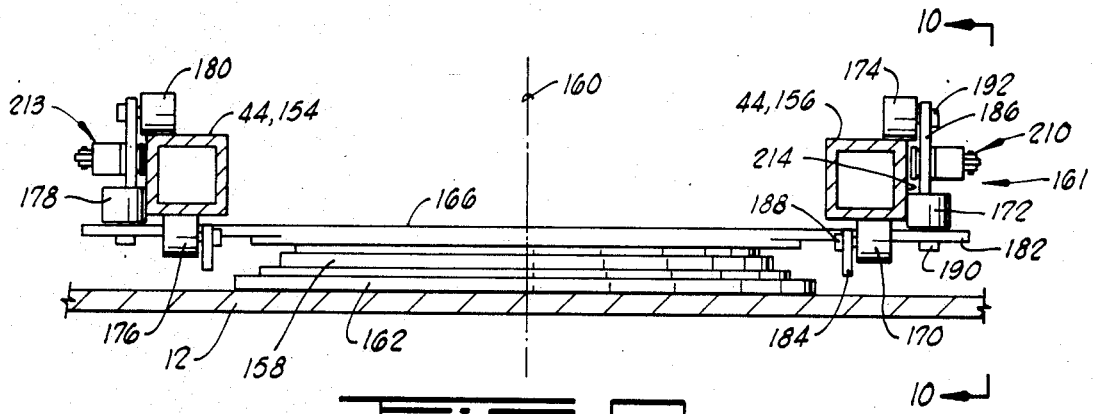
FIG. 9 is an elevation, partly section view of the rotatable connection between the discharge conveyor and the frame, and also of the sliding connection between the discharge conveyor and the frame.

Referring now to FIG. 9, the discharge conveyor apparatus 44 (the majority of which is not actually illustrated in FIG. 9) is supported from and includes a pair of square tubular rails 154 and 156.

A pivotal mounting means 158 is operably associated with a discharge conveyor means 44 for permitting the discharge conveyor means 44 to pivot about a substantially vertical axis 160 relative to the frame 12 of the apparatus 10.

Furthermore, an extension means generally indicated by the numeral 161 is operably associated with the discharge conveyor means 44 for permitting the discharge point 48 defined by the rearward end thereof to be moved horizontally relative to the frame 12.

Figure 10:
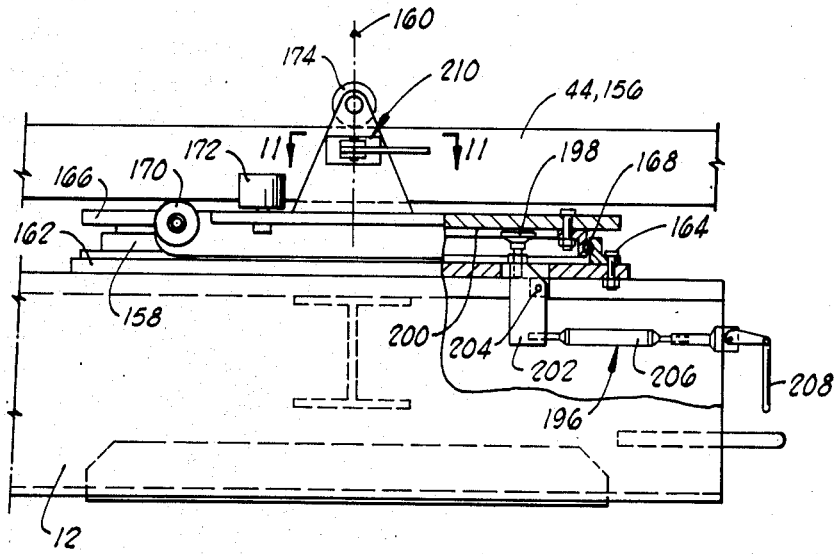
FIG. 10 is a side elevation view taken along line 10—10 of FIG. 9.

The pivotal mounting means 158, which is also seen in FIG. 10, includes a lower plate 162 which is attached to the frame 12 by suitable means such as bolts 164 or the like.

Pivotal mounting means 158 also includes an upper plate 166 which is rotatably mounted relative to lower plate 162 by an annular bearing 168 which is shown in cross section in FIG. 10.

Thus, the upper plate 166 of pivotal mounting means 158 may rotate about the vertical axis 160 relative to the lower plate 162 of pivotal mounting means 158.

The extension means 161 is comprised of a plurality of guide rollers 170, 172, and 174 which engage the rail 156, and similar guide rollers 176, 178 and 180 which engage the guide rail 154.

The upper plate 166 of pivotal mounting means 158 includes a horizontal extension 182 having a downward vertical extension 184 extending therefrom and an upward vertical extension 186 extending therefrom.

Guide roller 170 which may be referred to as a lower guide roller 170 is rotatably mounted on downward vertical extension 184 by suitable means such as bolt 188.

Guide roller 172 which may be referred to as side guide roller 172 is rotatably mounted on horizontal extension 182 by suitable means such as bolt 190.

Guide roller 174 which may be referred to as upper guide roller 174 is rotatably attached to upward vertical extension 186 by suitable means such as bolt 192.

Thus, the discharge conveyor means 44, and particularly its guide rails 154 and 156 may slide horizontally relative to frame 12 due to the action of the guide rollers 170, 172, 174, 178, 180 of extension means 161.

Figure 2:
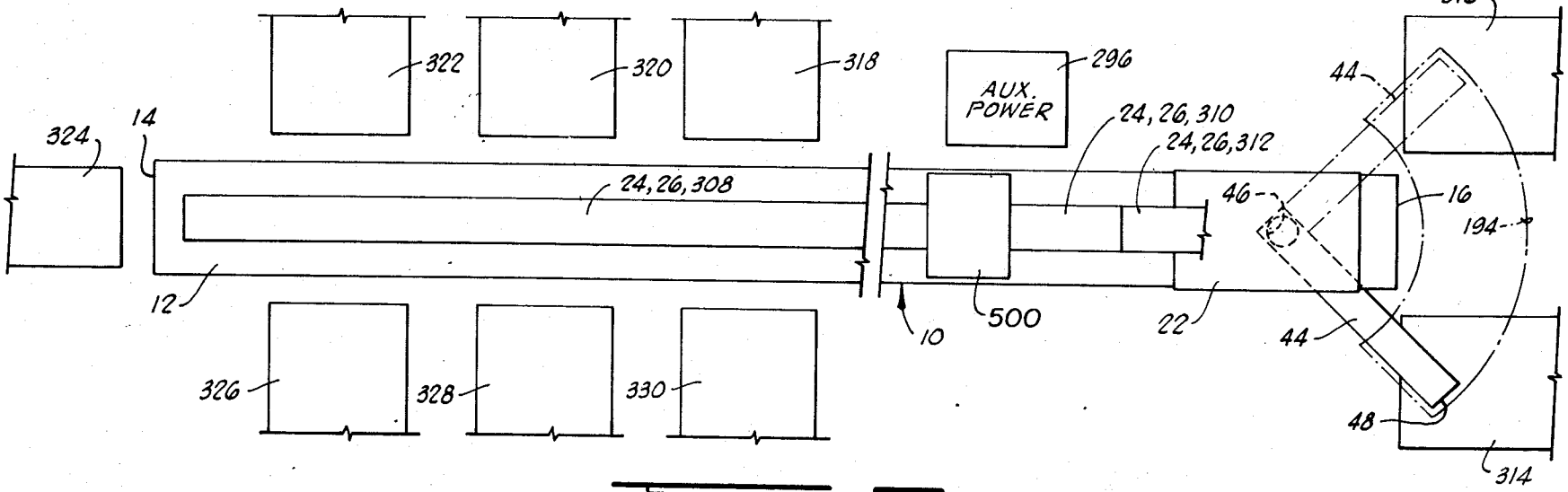
FIG. 2 is a schematic plan view of the apparatus of FIG. 1, along with a plurality of sources of proppant material, and two blender apparatus, to illustrate the manner in which the apparatus of the present invention is utilized in connection with these associated apparatus to provide proppant material as part of a well fracturing operation.

This combination of the pivotal mounting means 158 and the extension means 161 allows the discharge point defined by the rear end 48 of discharge conveyor means 44 to be selectively located within a predetermined arcuate area such as that indicated in phantom lines by the numeral 194 in FIG. 2. The arc of the area 194 is determined by the pivotal mounting means 158, and the width of the arcuate area is determined by the sliding extension provided by extension means 161.

In the preferred embodiment of the present invention, the pivotal mounting means 158 allows the discharge conveyor means 44 to swing through an arc of 90° about the vertical axis 160.

Operably associated with the pivotal mounting means 158 is a releasable pivot locking means generally indicated by the numeral 196 in FIG. 10, for holding the discharge conveyor means 44 at a selected angle relative to the frame 12.

The releasable pivot locking means 196 includes a friction engagement pad 198, constructed of steel which is arranged to be engaged with the lower surface 200 of upper plate 166 of pivotal mounting means 158.

The friction engagement pad 198 is attached to a bracket 202 which pivots about a pivot pin 204 relative to the fame 12.

The action of bracket 202 about pivot pin 204 to either engage or disengage the friction engagement pad 198 with the lower surface 200 of upper plate 166 is controlled by a linkage 206 which itself is operated by a manually engaged handle 208.

A releasable sliding locking means 210 is mounted on the upward vertical extension 186 of upper plate 166 for engagement with the guide rail 156 for holding the discharge conveyor means 44 at a selected extended position relative to the frame 12. A similar releasable locking means 213 is associated with guide rail 154.

Figure 11:
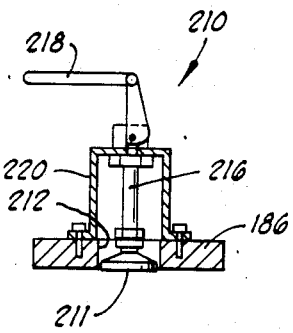
FIG. 11 is a plan section view taken along line 11—11 of FIG. 10 and illustrating the releasable holding means for the sliding extension of the discharge conveyor.

The releasable sliding locking means 210 is best seen in FIG. 11, and it similarly includes a friction engagement pad 211 which extends through an opening 212 in upward vertical extension 186 for engagement with an outer vertical surface 214 (see FIG. 9) of guide rail 156.

The friction engagement pad 211 is attached to a linkage 216 which is controlled by a manually engaged handle 218 all of which is mounted on a U-shaped bracket 220 which is attached to the upward vertical extension 186.

By operation of the handle 218, the friction engagement pad 211 can be snugly engaged with the outer vertical surface 214 of guide rail 156 to hold the discharge conveyor means 44 in a fixed longitudinal position relative to the frame 12.

Figure 8:
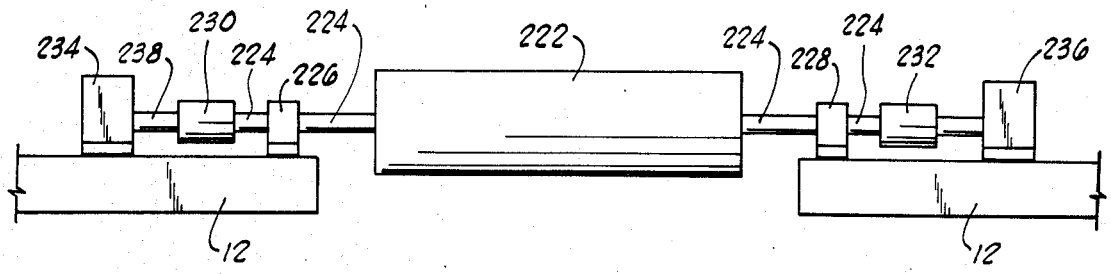
FIG. 8 is a somewhat schematic rear elevation view of a drive pulley for the gathering conveyor, illustrating the associated apparatus for powering the drive pulley.

Referring now to FIG. 8, the drive mechanism for the gathering conveyor means 24 is there somewhat schematically illustrated.

A drive pulley 222 of the gathering conveyor means 24 is located near its rearward end as seen in FIG. 3. The drive pulley 222 is illustrated in a rear elevation view in FIG. 8.

The drive pulley 222 is mounted on a shaft 22 which is supported relative to the frame 12 by first and second bearing blocks 226 and 228.

Attached to the ends of the shaft 224 are first and second overrunning clutches 230 and 232.

A first hydraulic drive motor 234 is connected to the first end of the shaft 224 through the first overrunning clutch 230.

A second hydraulic drive motor 236 is connected to a second end of the shaft 224 through the second overrunning clutch 232.

As will be understood by those skilled in the art, an overrunning clutch operates so that if the drive shaft 238 from the first motor 234 is turning faster than the shaft 224, then the clutch 230 will be engaged to fixedly connect the shafts 238 and 224 so that the shaft 224 is driven by the first hydraulic motor 234. On the other hand, if the shaft 224 is rotating faster than the drive shaft 238 of hydraulic motor 234, the hydraulic motor 234 will not be driving the shaft 224.

By utilizing two hydraulic motors, each connected to the main shaft 224 through separate overrunning clutches, the drive pulley 222 may be powered by either or both of the first and second drive motors 234.

The first hydraulic drive motor 234 is powered by a main power source which is shown in FIG. 1 and generally designated by the numeral 500. The main power source 238 is a typical power package comprised of a diesel engine, a hydraulic pump, and associated apparatus and controls.

It is contemplated that the second hydraulic drive motor 236 will function as an auxiliary motor and will be powered by an auxiliary power source as is further described below with regard to FIG. 12. This auxiliary power source will be independent from the first power source.

Figure 12:
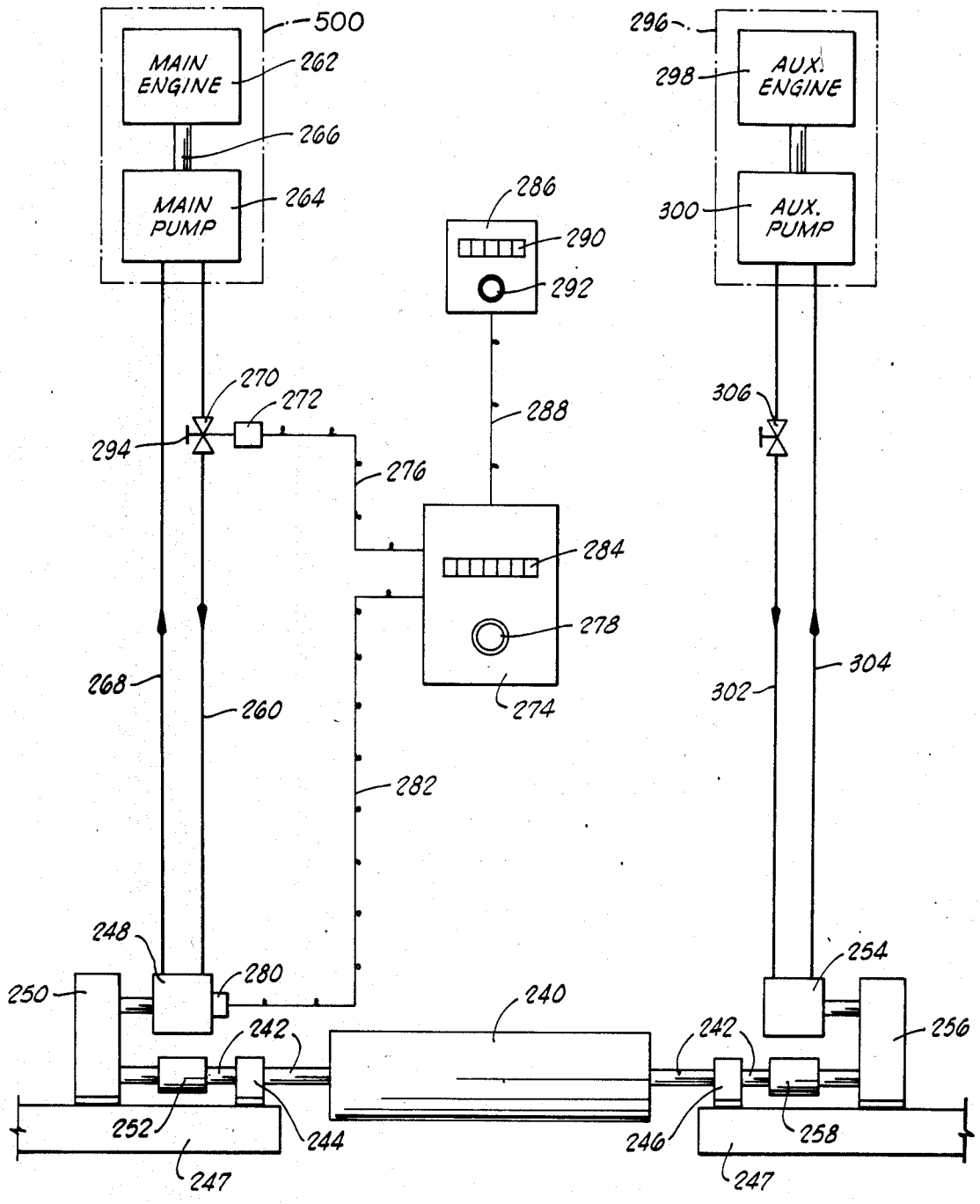
FIG. 12 is a schematic illustration of the hydraulic and electrical control system for controlling the speed of the discharge conveyor.

Referring now to FIG. 12, near the lower end thereof, there is shown a drive system for the discharge conveyor means 44, which is very similar to the drive system just described with regard to FIG. 8 regarding the gathering conveyor means 24.

A drive pulley 240 for the discharge conveyor means 44 is mounted on a shaft 242 which itself is mounted by bearing blocks 244 and 246 on a discharge conveyor frame 247.

A first hydraulic drive motor 248 drives the left end of the shaft 242 through a first speed reducing gear box 250 and a first overrunning clutch 252.

Similarly, a second hydraulic drive motor 254 drives the right end of shaft 242 through a second speed reducing gear box 256 and a second overrunning clutch 258.

The first hydraulic drive motor receives hydraulic fluid under pressure through fluid supply line 260 from the main power source 500 previously mentioned.

The main power source 500 includes a main engine 262 which preferably is an internal combustion diesel engine which drives a main hydraulic pump 264 through an interconnecting drive means 266.

Hydraulic fluid from the hydraulic motor 248 returns to the main pump 264 through a return line 268.

Disposed in the hydraulic fluid supply line 260 is a control valve 270. The control valve 270 has an electrically controlled operator 272 for controlling the position of the valve to control flow of hydraulic fluid to the drive motor 248 and to correspondingly control the drive speed of drive pulley 240 and the belt 88 of discharge conveyor means 44.

The position of electric valve operator 272 and of the valve 270 is varied in response to electrical signals sent from a control panel 274 through wiring 276 in response to the position of a manually controlled knob 278 which is attached to a potentiometer type control (not shown).

A tachometer sensor 280 is connected to the hydraulic drive motor 248 for monitoring the rotational speed of the hydraulic drive motor 248, and a signal is sent through wiring 282 back to the control panel 274. Based upon that signal, a digital readout is provided by display means 284 to indicate a volume rate of discharge of material from discharge conveyor 44 in cubic feet per minute. Readout 284 is calibrated based upon the discharge area determined by adjustable screed means 100 multiplied by the lateral speed of the belt 88 which is directly proportional to the rotational speed of hydraulic motor 248.

Thus, the human operator who is controlling the output from the transportable material conveyor apparatus 10 can determine the volume discharge rate from the discharge conveyor 44 merely by observing the display 284, and can vary that volume discharge rate merely by turning the knob 278.

Also, a remote control panel 286 is provided which is connected by wiring 288 to the main control panel and which includes a readout 290 and a control knob 292 which accomplish the same functions as the readout 284 and the control knob 278 previously described.

The provision of the remote control panel 286 permits the human operation to locate himself at any desired position relative to the apparatus 10 so that he can observe the discharge from the apparatus 10 into a blender apparatus and control the same merely by twisting the knob 292.

The control panels 274 and 286 of course include a great deal of instrumentation and other controls which are not illustrated. FIG. 12 only illustrates the control and the readout directly related to controlling the speed of the discharge conveyor 44.

The control valve 270 in hydraulic fluid supply line 260 also includes a manual override control 294 which allows the position of the valve 270 and the flow through fluid supply line 260 to be manually controlled in the event of electrical power failure.

Also schematically illustrated in FIG. 12 is an auxiliary power source 296 which includes an auxiliary engine 298 and an auxiliary pump 300.

The auxiliary power source 296 can be any suitable type of transportable power unit and is completely separate from the remainder of apparatus 10 illustrated in FIG. 1. Referring to the schematic plan illustration in FIG. 2, the auxiliary power source 296 is shown as being a separate unit located adjacent the apparatus 10. The purpose of the auxiliary power source 296 is to provide redundancy so that in event of failure of the primary power source 238. the fracturing job can continue uninterrupted. Redundancy in a proppant conveying system is important because you cannot stop a fracturing job in midstream without potentially wasting the entire job and perhaps ruining the well.

The second hydraulic motor 254 is connected to the auxiliary pump 300 through supply and return lines 302 and 304. A manually operated control valve 306 is disposed in the auxiliary supply line 302.

The hydraulic drive system illustrated in FIG. 8 for the gathering conveyor 24 is not shown in FIG. 12, but it is powered from main power source 500 and auxiliary power source 296 in a manner similar to that illustrated in FIG. 12.

Referring again to FIG. 1, some further features of the overall construction and arrangement of the apparatus 10 can best be described.

As previously mentioned, the frame 12 of apparatus 10 is an elongated frame having first and second ends 14 and 16.

The surge bin means 22 is located adjacent the second end 16 of frame 12.

The gathering conveyor means 24 is an elongated gathering conveyor means 24 extending substantially parallel to the elongated frame 12. Gathering conveyor means 24 includes a substantially horizontal first portion 308 located at a first elevation and nearest to the first end 14 of frame 12.

Gathering conveyor means 24 also includes an inclined second portion 310 extending from the first portion 308 upward to a second elevation and longitudinally rearward toward the second end 16 of frame 12.

Further, gathering conveyor means 24 includes a substantially horizontal third portion 312 at said second elevation and extending from the inclined second portion 310 to a position above surge bin means 22.

Finally, it is noted that the discharge conveyor means 44 which is located below the outlet 46 of surge bin means 22 is located at an intermediate elevation between the first elevation of horizontal first portion 308 of gathering conveying means 24 and the second elevation of horizontal third portion 312 of gathering conveyor means 24.

As previously mentioned, the discharge end 48 of discharge conveyor means 44 is horizontally extendible to a plurality of possible positions beyond the second end 16 of frame 12. The discharge conveyor means 44 is also retractable to a nonextended transport position as seen in FIG. 1, wherein it does not extend beyond the rear end 16 of frame 12, so as to minimize the overall length of the apparatus 10 so that it may be legally transported upon the highways.

As seen in FIG. 1, a deflector shield 313 extends from the rear end of discharge conveyor 44 to deflect downwardly the material ejected from the discharge conveyor belt 88.

SUMMARY OF OPERATION OF THE INVENTION

Referring now to FIG. 2, which is a schematic plan view of the apparatus 10 in combination with other associated apparatus with which it is used in performing a well fracturing job, the overall manner of operation of the apparatus 10 will now be described.

In FIG. 2, the apparatus 10 is very schematically illustrated, with its forward and rearward ends 14 and 16 being noted, and with the various portions 308, 310 and 312 of the gathering conveyor means 24 noted.

Also illustrated are the position of the main power source 238 and the position of the surge bin 22.

The discharge conveyor means 44 is illustrated in solid lines in its horizontally extended most position, and also pivoted to one extreme of its permissible pivotal motion relative to frame 12.

The other extreme pivotal position of discharge conveyor means 44 is illustrated in phantom lines.

The area which can be covered by the discharge end 48 of discharge conveyor means 44 is substantially arcuate in shape and has been designated by the phantom boundary lines indicated by the numeral 194 previously mentioned.

Also shown in FIG. 2 in place relative to the apparatus 10 are first and second blender apparatus 314 and 316 which it is seen are located near the rear end 16 of apparatus 10. They are located so that the discharge conveyor means 44 may be swung about its pivotal mounting so as to change the discharge point from a position above the first blender apparatus 314 to a position above the second blender apparatus 316 very rapidly.

Also shown in position relative to the first horizontal portion 308 of gathering conveyor means 24 are seven particulate material supply containers 318, 320, 322, 324, 326, 328, 330, each of which is arranged to discharge particulate material onto the moving conveyor belt 26 of gathering conveyor means 24.

In a preferred manner of use of the present invention, each of the particulate material supply containers 318, 320, 322, 324, 326, 328, 330 are large trailer type devices which are moved onto the well site and which are subsequently loaded with sand.

Each of the particulate material supply containers 318, 320, 322, 324, 326, 328, 330 utilizes its own discharge conveyor belt (not shown) which discharges material directly onto the gathering conveyor belt 26.

During a hydraulic fracturing job, a number of human operators will be involved with various parts of the equipment illustrated in FIG. 2.

One human operator will be operating the blender apparatus 314 and 316. Normally, only one blender apparatus is being utilized. The second blender is provided for redundancy in order that a job may be continued in case of a shutdown of the first blender.

The blender operator will be controlling the mixture of propant and the various fluids with which it is being blended to provide the appropriate mixture to be pumped downhole into the well.

A second operator will generally be controlling the placement of particulate material from the particulate material supply containers 318, 320, 322, 324, 326, 328, 330 onto the gathering conveyor means 24. This second human operator will be observing the level indicator lights 60, 62 and 64 (see FIG. 4) so as to maintain the particulate level within the surge bin 22 such that the lower and intermediate lights 64 and 62 are on and the upper light 60 is off.

The actual control of discharge of particulate material from the surge bin 22 onto the discharge conveyor 44 may be controlled by a third human operator, or in some instances, those functions may be controlled by the human operator who is controlling the blenders 314 and 316.

This control of the discharge of particulate material from the apparatus 10 is provided by two very simple means.

First, the position of the adjustable screed means 100 controls the cross-sectional area of material which can be carried by the belt 88 of discharge conveyor means 44, and the speed of the belt 88 is controlled by the control knob 278 on control panel 274 or alternatively by the control knob 292 on portable control panel 286.

The human operator who is controlling this discharge of particulate material from the apparatus 10 merely needs to observe the intake portion of the blenders 314 or 316 to make sure that this intake is always covered with particulate material, and also to avoid overfilling that intake.

The apparatus 10 therefore provides a system by which an operator can very easily control the discharge of particulate material into the blender 314 or 316 without overflowing the intake of the blender and also without permitting the intake of the blender to ever run dry.

Also, in the event of shutdown or failure of one of the blenders, the particulate discharge can immediately be swung or pivoted to a position over the other blender and the fracturing job continued without interruption.

Also, the apparatus 10 provides an important new capability of serving as a metering system for metering the amount of proppant to be mixed by the blender 314 or 316. As previously mentioned, the blender 314 or 316 normally performs the metering function itself, but in the event that the electrical system which controls the proppant metering function of the blender fails, it is possible to use the apparatus 10 to actually meter the rate at which proppant is mixed in the blender.

To use the apparatus 10 as a metering device, the human operator who is controlling the discharge conveyor 44 no longer attempts to keep the inlet of the blender full of proppant. Instead, he controls the speed of discharge conveyor belt 88 and the position of adjustable screed means 100 so as to deliver proppant to the blender at a desired rate. This is an important feature which is not practically achievable with prior art devices.

Thus it is seen that the present invention achieves the objects and advantages mentioned as well as those inherent therein. While certain preferred embodiments of the invention have been illustrated for the purposes of the present disclosure, numerous changes in the arrangement and construction of the various elements of the invention can be made by those skilled in the art which changes are encompassed within the scope and spirit of the invention as defined by the appended claims.

What is claimed is:

1. A transportable proppant material conveying apparatus used in transporting particulate proppant material from a particulate proppant material supply container to a mixing apparatus where said particulate proppant material is blended with fluids used in well operations at well sites, said transportable proppant material conveying apparatus comprising:

a transportable frame to facilitate the transportation of said apparatus to and from well sites;

a controllable gathering conveyor means, mounted on said frame, for gathering said particulate proppant material from said particulate proppant supply container and delivering said particulate proppant material to another location on the transportable frame;

a surge bin means, mounted on said frame, for receiving from said gathering conveyor, holding, and discharging said particulate proppant material to be transported to said mixing apparatus to be blended with said well fluids used in said well operations at well sites, said surge bin means having a holding capacity greater than the volume of said particulate proppant material which can be carried at one time by said gathering conveyor means, said surge bin means being so constructed that all of said particulate proppant material contained in said surge bin means can be discharged through a single outlet to thereby prevent the formation of dead spaces where substantial volumes of said particulate proppant material could be trapped within said surge bin means;

a discharge conveyor means, mounted on said frame below an outlet of said surge bin means, for receiving said particulate proppant material from said outlet and for conveying said particulate proppant material to a discharge point to be discharged into said mixing apparatus to be blended by said mixing apparatus with said well fluids in said well operations at well sites, said discharge conveyor means being independently controlled and capable of intermittent independent operation to control the flow of said particualte proppant material to said mixing apparatus to be blended with said fluids in said well operations at well sites, said discharge conveyor means including an endless conveyor belt;

adjustable screed means, operatively associated with said endless conveyor belt on a downstream side of said outlet of said surge bin means, for controlling a cross-sectional area of particulate proppant material which can be carried on said conveyor belt of said discharge conveyor means;

pivotal mounting means, operatively associated with said discharge conveyor means, for permitting said discharge conveyor means to pivot about a substantially vertical axis relative to said frame;

extension means, operably associated with said discharge conveyor means, for permitting said discharge point to be moved horizontally relative to said frame, said extension means and said pivotal mounting means permitting said discharge point to be selectively located within a predetermined area relative to said frame;

discharge control means, operably associated with said discharge conveyor means, for controlling a speed of said conveyor belt, so that a discharge rate of said particulate material from said discharge conveyor means is determined by a combination of said adjustable screed means and said discharge control means;

and discharge rate indicator means for indicating the rate at which particulate proppant material is being discharged into said mixing apparatus from said conveying apparatus to be blended with fluids used in well operations at well sites.

2. The apparatus of claim 1, further comprising:

external level indicator means, operably associated with said surge bin means, for providing a visually observable indication of a level of said particulate material within said surge bin means

3. The apparatus of claim 2, wherein:

said level indicator means includes a plurality of discrete level sensors within said surge bin means, and a plurality of indicator lights, one of which lights is associated with each of said sensors, said sensors and said lights being interconnected so that each of said lights is on when the level of said particulate material is at or above its associated sensor, and each of said lights is off when said level of said particulate material is below its associated sensor.

4. The apparatus of claim 1, wherein:

said gathering conveyor means includes an endless belt extending over a wall of said surge bin means so that discharge end of said gathering conveyor means is located above said surge bin means for discharging said particulate material from said endless belt into an upper end of said surge bin means; and said surge bin means includes:

a carryover hopper means, located directly below a return portion of said endless belt between said wall of said surge bin means and said discharge end of said gathering conveyor means, for receiving particulate material carried past said discharge end of said gathering conveyor means by said return portion of said endless belt; and a carryover discharge chute communicating said carryover hopper means with a portion of said outlet of said surge bin means nearest an upstream end of said discharge conveyor means, so that said particulate material is prevented from piling up within said surge bin means below said return portion of said endless belt.

5. The apparatus of claim 1, wherein said gathering conveyor means includes:

an endless conveyor belt;

a drive pulley operably associated with said endless conveyor belt for driving said belt;

a first drive motor connected to a first end of said drive pulley through a first overrunning clutch; and a second drive motor connected to a second end of said drive pulley through a second overrunning clutch, so that said drive pulley may be powered by either or both of said first and second drive motors.

6. The apparatus of claim 5, further comprising:

a first power source operably connected to said first drive motor to supply power thereto; and a second power source, independent from said first power source, operably connected to said second drive motor to supply power thereto.

7. The apparatus of claim 1, further comprising:

releasable pivot locking means, operably associated with said pivotal mounting means, for holding said discharge conveyor means at a selected angle relative to said frame.

8. The apparatus of claim 1, further comprising:

releasable sliding locking means, operably associated with said extension means, for holding said discharge conveyor at a selected extended position relative to said frame.

9. The apparatus of claim 1, wherein:

said frame is an elongated frame having first and second ends;

said surge bin means is located adjacent said second end of said frame;

said gathering conveyor means is an elongated gathering conveyor means extending substantially parallel to said elongated frame, said gathering conveyor means including:

a substantially horizontal first portion located at a first elevation and nearest to said first end of said frame;

an inclined second portion extending from said first portion upward to a second elevation and longitudinally toward said second end of said frame; and a substantially horizontal third portion at said second elevation, and extending from said inclined second portion to a position above said surge bin means;

and said discharge conveyor means is located at an intermediate elevation between said first and second elevations.

10. The apparatus of claim 1, wherein said discharge conveyor means includes:

an endless conveyor belt;

a drive pulley operably associated with said endless conveyor belt for driving said belt;

a first drive motor connected to a first end of said drive pulley through a first overrunning clutch; and a second drive motor connected to a second end of said drive pulley through a second overrunning clutch, so that said drive pulley may be powered by either or both of said first and second drive motors.

11. The apparatus of claim 1 wherein said discharge control means is remotely located with respect to said conveying apparatus.

12. The apparatus of claim 1 wherein said discharge control means is located on said conveying apparatus.

13. A transportable proppant material conveying apparatus used in transporting particulate proppant material from a particulate proppant material supply container to a mixing apparatus where said particulate proppant material is blended with fluids used in well operations at well sites, said transportable proppant material conveying apparatus comprising:

a transportable frame to facilitate the transportation of said apparatus to and from well sites;

a controllable gathering conveyor means, mounted on said frame, for gathering said particulate proppant material from said particulate proppant supply container and delivering said particulate proppant material to another location on the transportable frame;

a surge bin means, mounted on said frame, for receiving from said gathering conveyor, holding, and discharging said particulate proppant material to be transported to said mixing apparatus to be blended with said well fluids used in said well operations at well sites, said surge bin means having a holding capacity greater than the volume of said particulate proppant material which can be carried at one time by said gathering conveyor means, said surge bin means being so constructed that all of said particulate proppant material contained in said surge bin means can be discharged through single outlet to thereby prevent the formation of dead spaces where substantial volumes of said particulate proppant material could be trapped within said surge bin means;

a discharge conveyor means, mounted on said frame below an outlet of said surge bin means, for receiving said particulate proppant material from said outlet and for conveying said particulate proppant material to a discharge point to be discharged into said mixing apparatus to be blended by said mixing apparatus with said well fluids in said well operations at well sites, said discharge conveyor means being independently controlled and capable of intermittent independent operation to control the flow of said particulate proppant material to said mixing apparatus to be blended with said fluids in said well operations at well sites, said discharge conveyor means including an endless conveyor belt;

adjustable screed means, operatively associated with said endless conveyor belt on a downstream side of said outlet of said surge bin means, for controlling a cross-sectional area of particulate proppant material which can be carried on said conveyor belt of said discharge conveyor means;

pivotal mounting means, operatively associated with said discharge conveyor means, for permitting said conveyor means to pivot about a substantially vertical axis relative to said frame;

extension means, operably associated with said discharge conveyor means, for permitting said discharge point to be moved horizontally relative to said frame, said extension means and said pivotal mounting means permitting said discharge point to be selectively located within a predetermined area relative to said frame;

discharge control means, operably associated with said discharge conveyor means, for controlling the speed of said conveyor belt, so that a discharge rate of said particulate material from said discharge conveyor means is determined by a combination of said adjustable screed means and said discharge control means;

discharge rate indicator means for indicating the rate at which particulate proppant material is being discharged into said mixing apparatus from said conveying apparatus to be blended with fluids used in well operations at well sites;

and a first power source located on said transportable frame for powering said controllable gathering means and said discharge conveyor means.

14. The apparatus of claim 13, further comprising:

a second power source independent of said first power means for powering said controllable gathering means and said discharge means.

15. The apparatus of claim 13 wherein said first power source comprises an internal combustion engine driving a hydraulic pump means to supply hydraulic fluid under pressure to drive hydraulic motor means connected to said controllable means and said discharge conveyor means.

16. The apparatus of claim 14 wherein:

said first power source comprises an internal combustion engine driving a hydraulic pump means to supply hydraulic fluid under pressure to drive hydraulic motor means connected to said controllable gathering means and said discharge conveyor means;

and said second power source comprises an internal combustion engine driving a hydraulic pump means to supply hydraulic fluid under pressure to drive hydraulic motor means connected to said controllable gathering means and said discharge conveyor means.

17. The apparatus of claim 13 wherein said discharge control means is remotely located with respect to said conveying apparatus.

18. The apparatus of claim 13 wherein said discharge control means is located on said conveying apparatus.

* * * * *

UNITED STATES PATENT AND TRADEMARK OFFICE

CERTIFICATE OF CORRECTION

PATENT NO. : 4,701,095

DATED : October 20, 1987

INVENTOR(S) : Leslie N. Berryman et al.

It is certified that error appears in the above-identified patent and that said Letters Patent is hereby corrected as shown below:

In Column 10, line 28, delete the numeral [22] and insert therefor --224--.

Signed and Sealed this

Twelfth Day of April, 1988

*Attest:*

DONALD J. QUIGG

*Attesting Officer*

*Commissioner of Patents and Trademarks*